US010252887B2

(12) United States Patent
Fauconnet et al.

(10) Patent No.: US 10,252,887 B2
(45) Date of Patent: Apr. 9, 2019

(54) LOCKING SYSTEM FOR TRAP OR PANELS OF AN ELEVATOR CAR AND METHOD OF CONTROLLING ACCESS TO AN ELEVATOR SHAFT FROM INSIDE THE CAR

(71) Applicant: OTIS ELEVATOR COMPANY, Farmington, CT (US)

(72) Inventors: Aurelien Fauconnet, Isdes (FR); Pascal Rebillard, Gien (FR); Alain Simonot, Orleans (FR)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 15/564,608

(22) PCT Filed: Apr. 7, 2015

(86) PCT No.: PCT/IB2015/000544

§ 371 (c)(1),
(2) Date: Oct. 5, 2017

(87) PCT Pub. No.: WO2016/162710

PCT Pub. Date: Oct. 13, 2016

(65) Prior Publication Data

US 2018/0072538 A1 Mar. 15, 2018

(51) Int. Cl.
*B66B 11/02* (2006.01)

(52) U.S. Cl.
CPC ..... *B66B 11/0253* (2013.01); *B66B 11/0246* (2013.01)

(58) Field of Classification Search
CPC ..... B66B 11/0253; B66B 11/0246
See application file for complete search history.

(56) References Cited

U.S. PATENT DOCUMENTS 740,154 A 9/1903 Magnuson et al.
1,344,430 A 6/1920 Wigmore et al.
(Continued)

FOREIGN PATENT DOCUMENTS

EP 0462006 * 6/1991
EP 0867398 A1 9/1998
(Continued)

OTHER PUBLICATIONS

International Search Report and Written Opinion of the International Searching Authority regarding related PCT App. No. PCT/IB2015/000544; dated Dec. 4, 2015; 12 pages.

*Primary Examiner* — Michael A Riegelman
(74) *Attorney, Agent, or Firm* — Cantor Colburn LLP

(57) ABSTRACT

A locking system for an elevator car includes a moveable panel of the elevator car moveable between an open position and a closed position, wherein the open position provides access to a region external to the elevator car. Also included is a plate operatively coupled to an exterior surface of the moveable panel. Further included is a magnetic locking member operatively coupled to an exterior surface of a fixed panel of the elevator car in communication with an electrical member, wherein the plate exerts magnetic forces with the magnetic locking member, the magnetic locking member magnetically coupled to the plate in a first electrical condition of the electrical member to maintain the moveable panel in the closed position and decoupled from the plate in a second electrical condition of the electrical member to allow the moveable panel to be moved to the open position.

11 Claims, 5 Drawing Sheets

(56) References Cited

U.S. PATENT DOCUMENTS

| | | | | |
|---|---|---|---|---|
| 4,009,767 | A | 3/1977 | Stadigh | |
| 4,462,193 | A * | 7/1984 | Ericson | B66B 11/0253 24/306 |
| 6,202,801 | B1 * | 3/2001 | Muller | B66B 11/0246 187/269 |
| 7,445,089 | B2 | 11/2008 | Kuipers et al. | |
| 7,823,699 | B2 | 11/2010 | Gieras et al. | |
| 8,100,363 | B2 | 1/2012 | Ponsart et al. | |
| 2004/0050628 | A1 | 3/2004 | Fujita et al. | |
| 2004/0055829 | A1 * | 3/2004 | Morris | B66B 13/08 187/316 |
| 2010/0155184 | A1 * | 6/2010 | Sirigu | B66B 5/0068 187/302 |
| 2010/0200339 | A1 * | 8/2010 | Henseler | B66B 5/005 187/401 |
| 2012/0205505 | A1 * | 8/2012 | Piech | B66B 13/12 248/206.5 |
| 2013/0043098 | A1 | 2/2013 | Baltisser et al. | |
| 2013/0118841 | A1 * | 5/2013 | Zhang | B66B 11/0253 187/401 |
| 2015/0246792 | A1 * | 9/2015 | Baltis | B66B 11/0246 187/276 |
| 2017/0297870 | A1 * | 10/2017 | Fauconnet | B66B 11/0226 |
| 2018/0079621 | A1 * | 3/2018 | Fauconnet | B66B 5/0087 |
| 2018/0111797 | A1 * | 4/2018 | Fauconnet | B66B 11/0253 |
| 2018/0127244 | A1 * | 5/2018 | Fauconnet | B66B 19/00 |

FOREIGN PATENT DOCUMENTS

| | | | | |
|---|---|---|---|---|
| EP | 2727875 | A1 | 5/2014 | |
| GB | 2506628 | A | 4/2014 | |
| WO | 0179104 | A1 | 10/2001 | |
| WO | 0189977 | A1 | 11/2001 | |
| WO | WO-2008/034915 | * | 3/2008 | |
| WO | 2009036583 | | 3/2009 | |
| WO | 2011000064 | A1 | 1/2011 | |
| WO | 2011075142 | A1 | 6/2011 | |
| WO | WO-2011/000064 | * | 6/2011 | |
| WO | WO-2017063702 | A1 * | 4/2017 | B66B 11/0253 |

* cited by examiner

LOCKING SYSTEM FOR TRAP OR PANELS OF AN ELEVATOR CAR AND METHOD OF CONTROLLING ACCESS TO AN ELEVATOR SHAFT FROM INSIDE THE CAR

CROSS-REFERENCE TO RELATED APPLICATIONS

This patent application is a National Stage Application of International Patent Application Serial No. PCT/IB2015/000544, filed Apr. 7, 2015, which is incorporated herein by reference in its entirety.

BACKGROUND OF THE INVENTION

The subject matter disclosed herein relates to elevator systems and, more particularly, to a locking system for use with elevator cars, as well as a method of controlling access to an elevator shaft from the inside of the car.

Elevators with a low pit and/or a low overhead are advantageous because of the reduced impact of their installation on the construction cost and because of the compatibility with severe architectural constraints. These designs, however, result in mechanics being tasked with going to the top of the car, or into the pit for inspection or maintenance activities. In addition to authorized access, unauthorized access into the elevator shaft may also occur. As such, certain regulatory measures, particularly in Europe, have been proposed and/or enacted that will require larger spaces at the top of the elevator shaft and within the pit. This required additional space is undesirable from a construction and architectural standpoint.

Based on the considerations discussed above, elevator designers are seeking solutions to prevent and to control elevator shaft access, especially for non-authorized individuals. The access control must be achieved in a robust manner if small elevator shaft dimensions are to be proposed. One access control method is to provide locking side or rear panels, as well as ceiling and floor doors of an elevator car to prevent an individual from gaining access to the elevator shaft from a location within an elevator car. For example, a key may be required to unlock a panel or door. Alternatively, mechanical fasteners may be used to secure the potential access location in a locked condition. Unfortunately, these locking systems leave open the undesirable possibility that any individual possessing the key to the lock or tools compatible with the mechanical fasteners may be able to enter the elevator shaft from inside the elevator car.

BRIEF DESCRIPTION OF THE INVENTION

According to one aspect of the invention, a locking system for an elevator car includes a moveable panel of the elevator car moveable between an open position and a closed position, wherein the open position provides access to a region external to an interior space of the elevator car. Also included is a fixed panel of the elevator car. Also included is a plate operatively coupled to one of an exterior surface of the moveable panel and an exterior surface of the fixed panel. Further included is a magnetic locking member operatively coupled to one of the exterior surface of the moveable panel and the exterior surface of the fixed panel, wherein the plate exerts magnetic forces with the magnetic locking member, the magnetic locking member in communication with an electrical member, the magnetic locking member magnetically coupled to the plate in a first electrical condition of the electrical member to maintain the moveable panel in the closed position and decoupled from the plate in a second electrical condition of the electrical member to allow the moveable panel to be moved to the open position.

In addition to one or more of the features described above, or as an alternative, further embodiments may include that the moveable panel comprises a portion of a ceiling of the elevator car.

In addition to one or more of the features described above, or as an alternative, further embodiments may include that the moveable panel comprises a portion of a floor of the elevator car.

In addition to one or more of the features described above, or as an alternative, further embodiments may include that the moveable panel comprises a portion of a side wall of the elevator car.

In addition to one or more of the features described above, or as an alternative, further embodiments may include that the electrical member comprises a coil at least partially surrounding the magnetic locking member.

In addition to one or more of the features described above, or as an alternative, further embodiments may include that the first electrical condition comprises an un-energized condition of the electrical member and the second electrical condition comprises an energized condition of the electrical member.

In addition to one or more of the features described above, or as an alternative, further embodiments may include that the first electrical condition comprises an energized condition of the electrical member and the second electrical condition comprises an un-energized condition of the electrical member.

In addition to one or more of the features described above, or as an alternative, further embodiments may include that the plate comprises an alignment member coupled to the moveable panel to maintain alignment between the plate and the magnetic locking member.

In addition to one or more of the features described above, or as an alternative, further embodiments may include that the alignment member comprises a ball joint.

In addition to one or more of the features described above, or as an alternative, further embodiments may include that the alignment member comprises a spring.

In addition to one or more of the features described above, or as an alternative, further embodiments may include a car operating panel controlling the electrical condition of the electrical member with an elevator car power supply in electrical communication with the electrical member, the car operating panel selectively controlled by an authorized operator.

In addition to one or more of the features described above, or as an alternative, further embodiments may include that the moveable panel is completely removable.

According to another aspect of the invention, a method of controlling access to an elevator shaft is provided. The method includes maintaining a moveable panel of an elevator car in a closed position while a magnetic locking member is in a first electrical condition and magnetically coupled to a plate operatively coupled to an exterior surface of the moveable panel, wherein the plate exerts magnetic forces with the magnetic locking member. The method also includes unlocking the moveable panel to permit movement to an open position upon switching the magnetic locking member to a second electrical condition to decouple the magnetic locking member from the plate.

In addition to one or more of the features described above, or as an alternative, further embodiments may include unlocking the moveable panel comprises manually operating a car operating panel of the elevator car to switch the electrical condition of the electrical member with an elevator car power supply in electrical communication with the electrical member.

In addition to one or more of the features described above, or as an alternative, further embodiments may include unlocking the moveable panel comprises energizing the electrical member to de-magnetize the magnetic locking member.

In addition to one or more of the features described above, or as an alternative, further embodiments may include unlocking the moveable panel comprises de-energizing the electrical member to de-magnetize the magnetic locking member.

These and other advantages and features will become more apparent from the following description taken in conjunction with the drawings.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
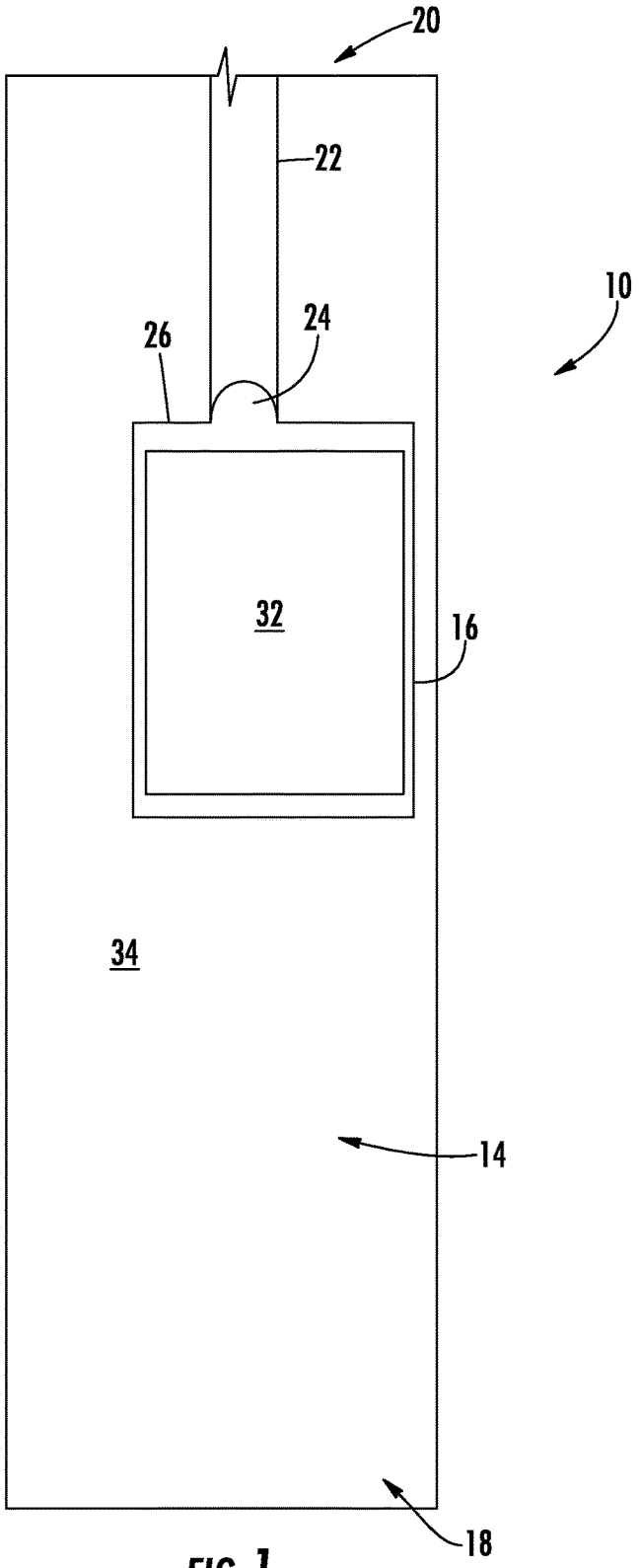
FIG. 1 is a schematic illustration of an elevator system.

Referring to FIG. 1, an elevator assembly is illustrated and generally referenced with numeral 10. The elevator assembly 10 includes an elevator car 16 (which may also be referred to as a lift car) that moves along guide rails in a known manner. The elevator car 16 is disposed within an elevator shaft 14 and is moveable therein, typically in a vertical manner. In one embodiment, the elevator car 16 essentially moves along the entire length of the elevator shaft 14 between a lower end 18 (i.e., a pit) and an upper end 20. A drive system (not illustrated) includes a motor and brake and is conventionally used to control the vertical movements of the elevator car 16 along the elevator shaft 14 via a traction system (partially illustrated) that includes cables, belts or the like 22 and at least one pulley 24. It should be readily appreciated as well that, although the elevator assembly 10 is disclosed herein as including a pulley 24, the elevator assembly 10 can be implemented with other drive systems, such as a linear motor-driven elevator (e.g., a ropeless, self-propelled elevator).

Figure 3:
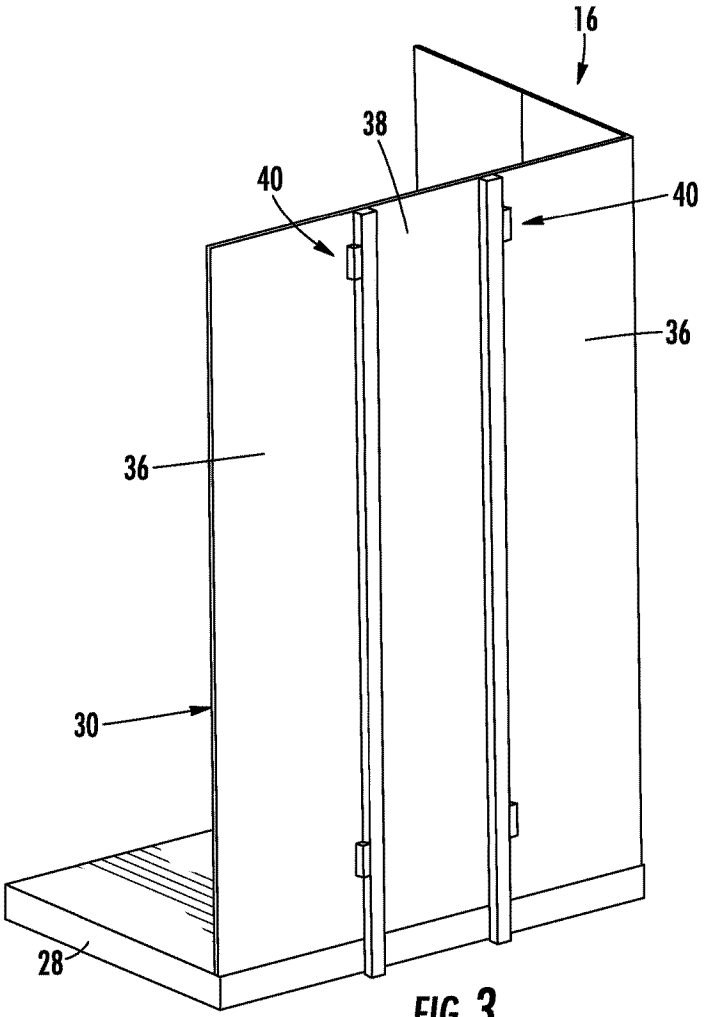
FIG. 3 is a perspective view of an exterior region of the elevator car.
Figure 2:
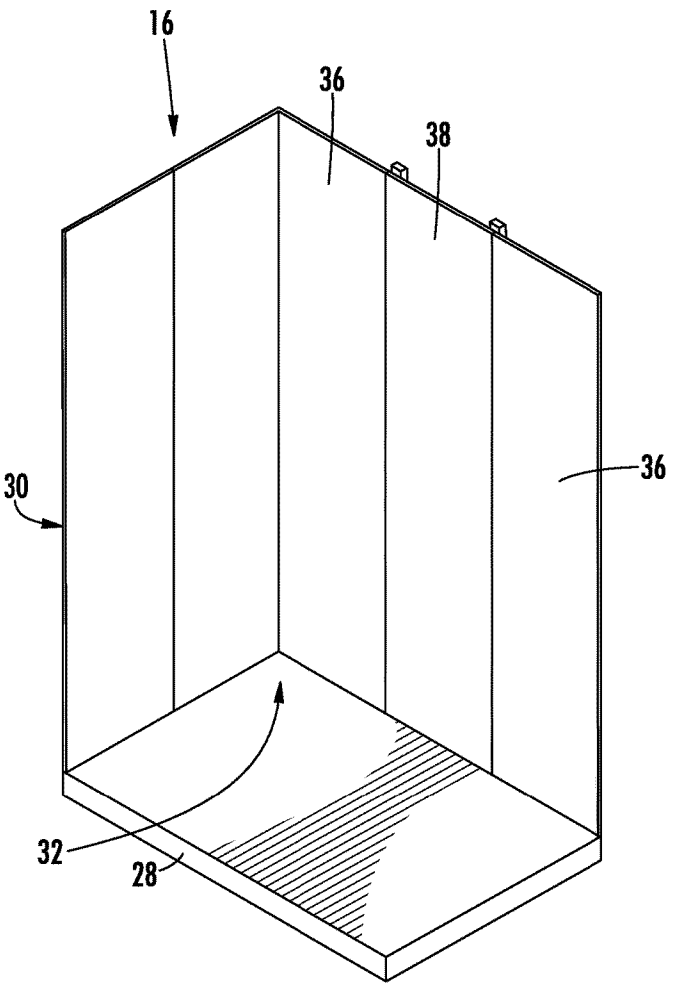
FIG. 2 is a perspective view of an interior region of an elevator car of the elevator system.

Referring to FIGS. 2 and 3, with continued reference to FIG. 1, the elevator car 16 includes a car roof 26, a car floor 28 and a plurality of side walls 30. Together, the car roof 26, the car floor 28 and the plurality of side walls 30 define an interior region 32 that is dimensioned to carry standing passengers and/or cargo during operation of the elevator car within the overall elevator system.

The region surrounding the elevator car 10, specifically the region surrounding exterior surfaces of the car roof 26, the car floor 28 and the plurality of side walls 30, is referred to herein as an external region 34. Generally, the external region 34 includes surrounding space within the elevator shaft 14 through which the elevator car 16 travels. However, it is to be appreciated that the external 34 region also refers to regions outside of the interior space of the elevator car 10. This may include components attached to the elevator car 10, but that are not accessible to a passenger in the interior space. For example, a safety block, buffers, car guide shoes, rollers and controller cabinets.

Figure 4:
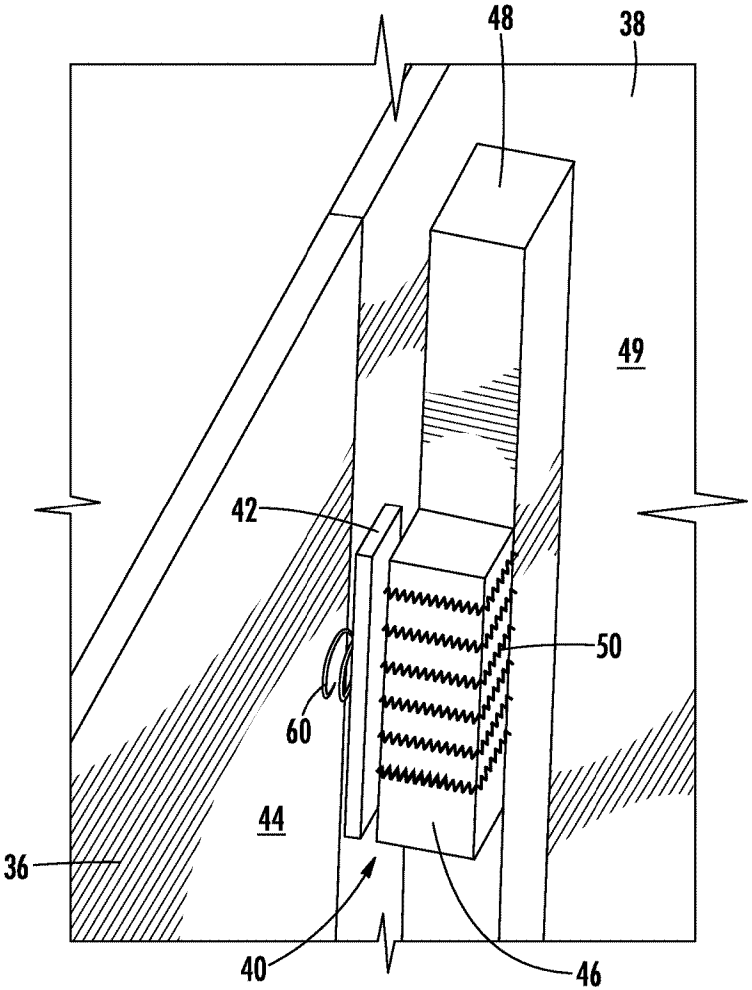
FIG. 4 is a perspective view of a locking system of the elevator car in a locked condition to maintain a moveable panel of the elevator car in a closed position.
Figure 7:
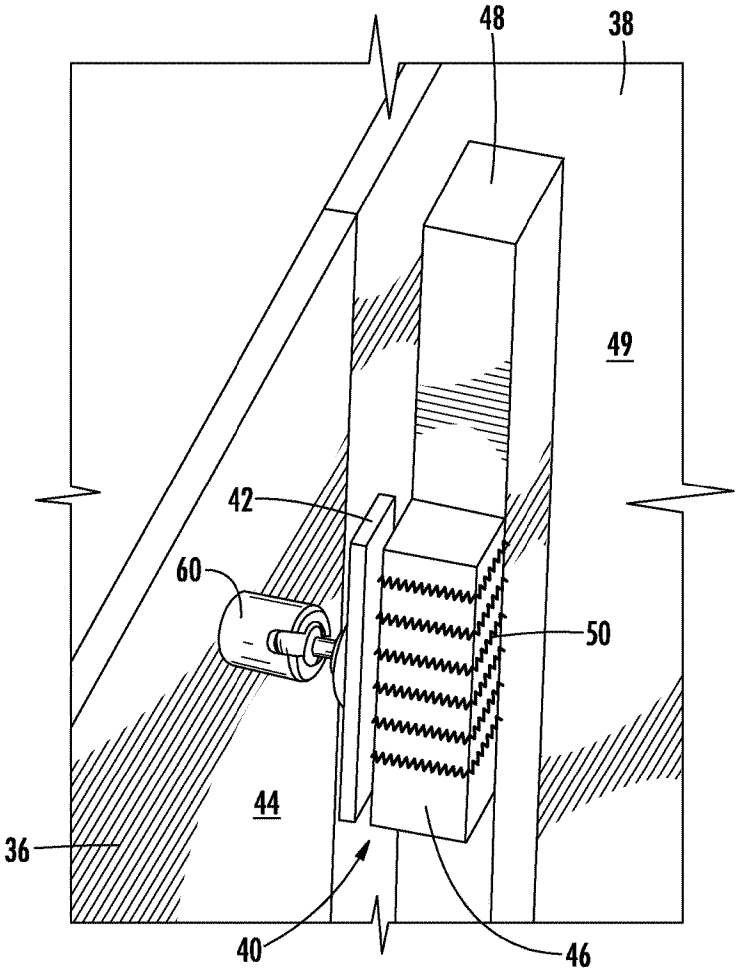
Figure 6:
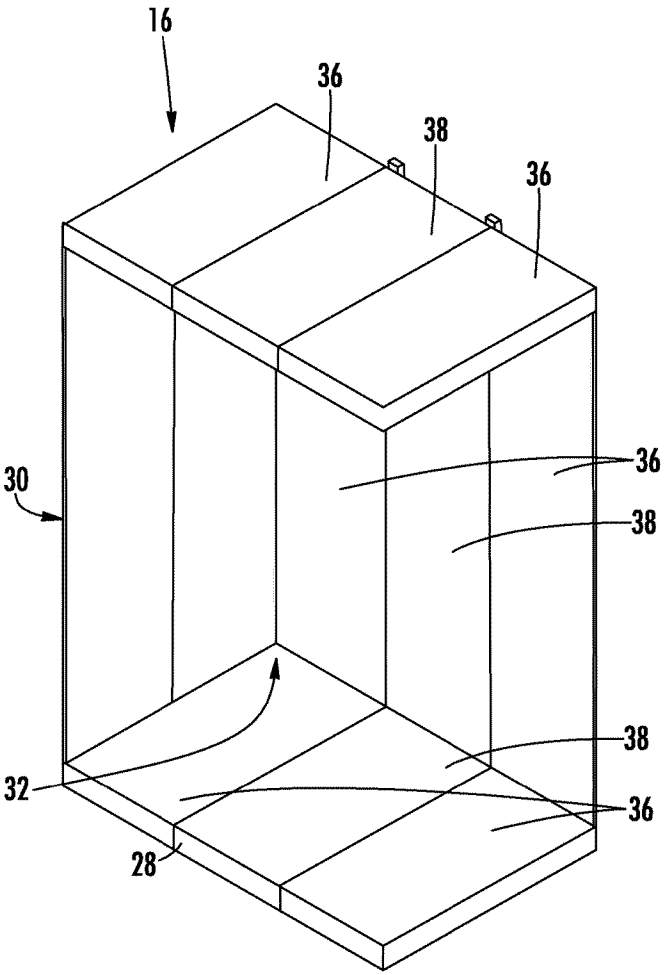
Figure 9:
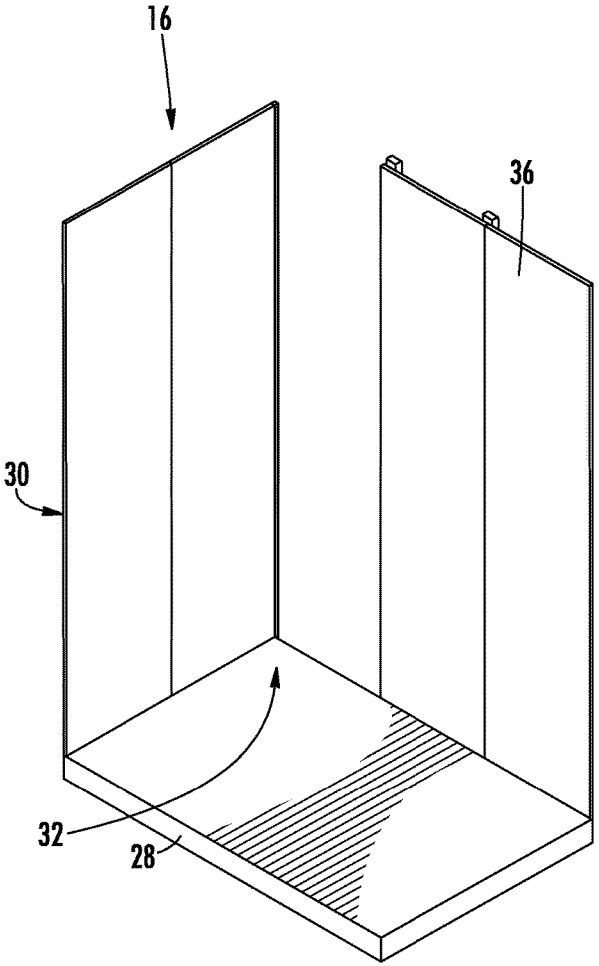
Figure 8:
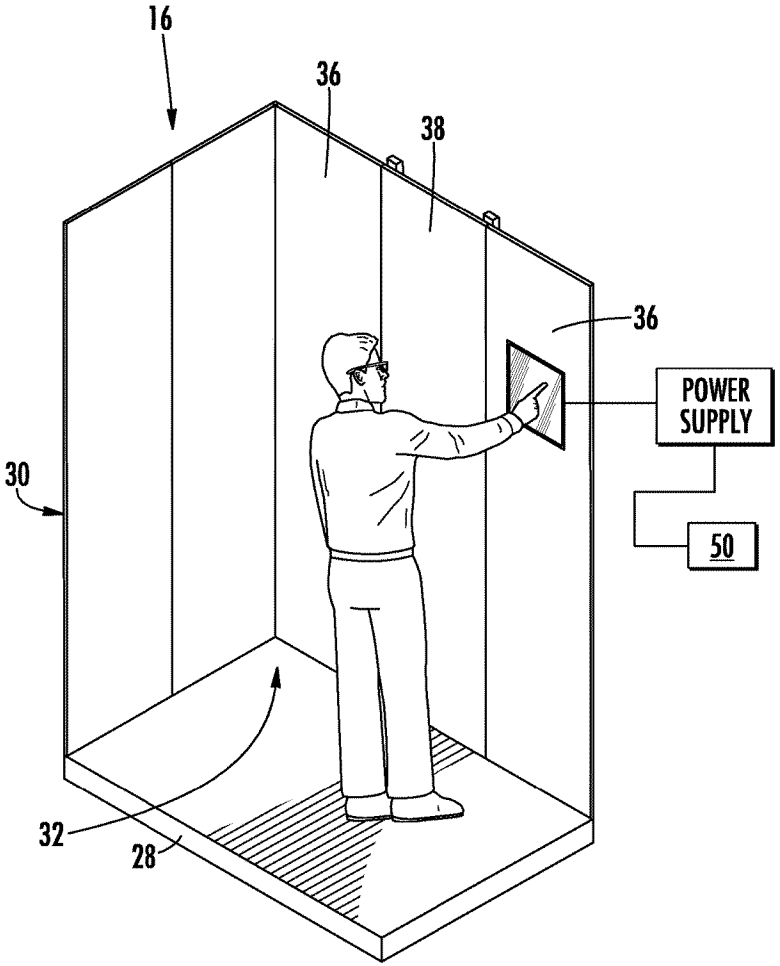

The elevator car 16 includes a moveable panel 36 that forms all or a portion of the car roof 26, the car floor 28, and/or the plurality of side walls 30. In other words, the moveable panel 36 may be a ceiling panel, a floor panel, and/or a side wall panel that is moveable between an open position (FIG. 5) and a closed position (FIGS. 2-4). In the open position, the moveable panel 36 provides access to the external region 34. Therefore, an authorized operator may be required to move the moveable panel 36 to the open position in order to perform a service activity in the external region 34. It is to be appreciated that the moveable panel 36 is completely removable in some embodiments.

The elevator car 16 also includes at least one fixed object disposed in close proximity to the moveable panel. In the illustrated example of a moveable panel 36 that is part of one of the plurality of side walls 30, the fixed object is a fixed panel 38 located adjacent the moveable panel 36. It is to be appreciated that there may be more than one moveable panel and more than one fixed panel.

Figure 5:
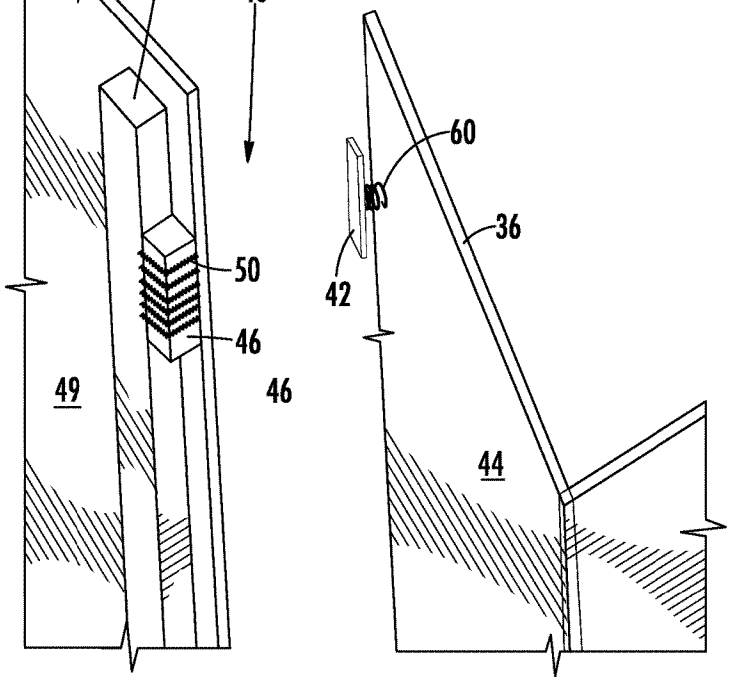
FIG. 5 is a perspective view of the locking system in an unlocked condition to permit movement of the moveable panel to an open position.

As shown best in FIGS. 3-5, a locking system 40 is integrated with the moveable panel 36 and provided to limit access to the elevator shaft 14 to authorized personnel. As will be appreciated from the description herein, the locking system 40 prevents unlocking and opening of the moveable panel 36 by an individual who is simply in possession of a key to unlock the door or a tool that may unlock a door relying on mechanical fasteners or the like.

Referring now to FIGS. 4 and 5, the locking system 40 includes a plate 42 that is operatively coupled to an exterior surface 44 of the moveable panel 36. Coupling may be made directly or indirectly and in any suitable manner that maintains a fixed relationship between the plate 42 and the moveable panel 36. The locking system 40 also includes a magnetic locking member 46 that is operatively coupled to the fixed panel 38 of the elevator car 16. As with the plate 42, the magnetic locking member 46 may be coupled to the fixed panel 38 in a direct or indirect manner. In the illustrated embodiment, an indirect coupling is made, as the magnetic locking member is coupled to an upright structure 48 that is fixed to an exterior surface 49 of the fixed panel 38.

The magnetic locking member 46 is positioned to be in contact with the plate 42 when the moveable panel 36 is in the closed position. The contact between the magnetic locking member 46 and the plate 42 maintains the moveable panel 36 in the closed position. The plate 42 is formed of a material that is reactive to and/or configured to exert magnetic forces with the magnetic locking member 46. For example, the plate 42 is formed of a ferromagnetic material, a ferrimagnetic material, or even a magnet itself. The preceding list is merely illustrative and is not intended to be limiting, as any suitable material that is reactive to the magnetic locking member 46 is contemplated. The magnetic force between the two objects is sufficient to maintain the moveable panel 36 in a locked position, such that an individual located within the interior region 32 of the elevator car 16 may not manipulate the moveable panel 36 to the open position.

The magnetic locking member 46 is switchable between a magnetized condition and a de-magnetized condition, thereby allowing a user to selectively de-magnetize the magnetic locking member 46 to facilitate unlocking the moveable panel 36. Switching between these conditions is facilitated by an electrical member 50 that the magnetic locking member 46 is in operable communication with. The electrical member 50 may be in direct or indirect contact with the magnetic locking member 46. In one embodiment, the magnetic locking member 46 is at least partially surrounded by the electrical member 50, with the electrical member 50 being in the form of a coil. The electrical member 50 is switchable between a first electrical condition and a second electrical condition. The electrical condition of the electrical member 50 determines whether the magnetic locking member 46 is in the magnetized or de-magnetized condition. For example, the first electrical condition maintains the magnetic locking member 46 in a magnetized condition that keeps the magnetic locking member 46 magnetically coupled to the plate 42, thereby disposing the moveable panel 36 in the closed and locked position. In the second electrical condition, the magnetic locking member 46 is in a de-magnetized condition that reduces or eliminates the magnetic attraction between the magnetic locking member 46 and the plate 42, thereby allowing the moveable panel 36 to open upon decoupling of the magnetic locking member 46 and the plate 42.

The respective electrical conditions that facilitate magnetizing and de-magnetizing of the magnetic locking member 46 may vary depending upon the particular application. For example, in a first embodiment, the first electrical condition comprises an un-energized condition of the electrical member 50 and the second electrical condition comprises an energized condition of the electrical member 50. In such an embodiment, an authorized user must take an action to energize the electrical member 50 to de-magnetize the magnetic locking member 46. This may be done in a number of ways. For example, a car operating panel integrated with the elevator car 16 is in electrical communication with the electrical member 50 and utilized to selectively supply power to the electrical member 50 upon a sufficient prompt from an authorized user. The prompt may be done by entering a code via buttons or a touch screen, for example. Additionally wireless prompts are also contemplated. As an alternative to the first embodiment described above, in a second embodiment, the first electrical condition comprises an energized condition of the electrical member 50 and the second electrical condition comprises an un-energized condition of the electrical member 50. In such an embodiment, an authorized user must take an action to de-energize the electrical member 50 to de-magnetize the magnetic locking member 46.

An alignment member 60 is provided in some embodiments to assist in maintaining alignment of the plate 42 relative to the magnetic locking member 46 during magnetic coupling of the components. The alignment member 60 is disposed between the plate 42 and the moveable panel 36 in the illustrated embodiment, but other locations may be suitable. In the illustrated embodiment, the alignment member 60 is coupled to the moveable panel 36. A spring and/or ball joint may be employed, for example.

Advantageously, a de-magnetized condition of the magnetic locking member 46 is required to switch the moveable panel 36 from the locked condition (FIGS. 2-4) to the unlocked condition (FIG. 5). As described in detail above, the energized or de-energized condition required for de-magnetization is only achieved by a predetermined input by an authorized individual, thereby ensuring that access to the elevator shaft 14 is securely controlled. The locking system 40 prevents individuals from being in the external region 34, including above the elevator car 16 and in the pit of the elevator shaft 14. This system and method allows regions of the elevator shaft 14 to be reduced in volume, which is desirable for architectural and construction purposes.

Although illustrated and described herein with the magnetic locking member 46 operatively coupled to the fixed panel 38 and the plate 42 operatively coupled to the moveable panel 36, it is to be understood that the reverse situation is true in some embodiments. Specifically, the magnetic locking member 46 is operatively coupled to the moveable panel 36 and the plate 42 is operatively coupled to the fixed panel 38.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. A locking system for an elevator car comprising:

a moveable panel of the elevator car moveable between an open position and a closed position, wherein the open position provides access to a region external to an interior space of the elevator car;

a fixed panel of the elevator car;

a plate operatively coupled to one of an exterior surface of the moveable panel and an exterior surface of the fixed panel; and a magnetic locking member operatively coupled to one of the exterior surface of the moveable panel and the exterior surface of the fixed panel, wherein the plate exerts magnetic forces with the magnetic locking member, the magnetic locking member in communication with an electrical member, the magnetic locking member magnetically coupled to the plate in a first electrical condition of the electrical member to maintain the moveable panel in the closed position and decoupled from the plate in a second electrical condition of the electrical member to allow the moveable panel to be moved to the open position, the plate comprising an alignment member coupled to the moveable panel to maintain alignment between the plate and the magnetic locking member.

2. The locking system of claim 1, wherein the moveable panel comprises a portion of a ceiling of the elevator car.

3. The locking system of claim 1, wherein the moveable panel comprises a portion of a floor of the elevator car.

4. The locking system of claim 1, wherein the moveable panel comprises a portion of a side wall of the elevator car.

5. The locking system of claim 1, wherein the electrical member comprises a coil at least partially surrounding the magnetic locking member.

6. The locking system of claim 1, wherein the first electrical condition comprises an un-energized condition of the electrical member and the second electrical condition comprises an energized condition of the electrical member.

7. The locking system of claim 1, wherein the first electrical condition comprises an energized condition of the electrical member and the second electrical condition comprises an un-energized condition of the electrical member.

8. The locking system of claim 1, wherein the alignment member comprises a ball joint.

9. The locking system of claim 1, wherein the alignment member comprises a spring.

10. The locking system of claim 1, further comprising a car operating panel controlling the electrical condition of the electrical member with an elevator car power supply in electrical communication with the electrical member, the car operating panel selectively controlled by an authorized operator.

11. The locking system of claim 1, wherein the moveable panel is completely removable.

* * * * *